US012330860B2

(12) United States Patent
Le Faou et al.

(10) Patent No.: US 12,330,860 B2
(45) Date of Patent: Jun. 17, 2025

(54) METERING VALVE

(71) Applicant: APTAR FRANCE SAS, Le Neubourg (FR)

(72) Inventors: Philippe Le Faou, Ecully (FR); Benjamin Manon, Ecully (FR)

(73) Assignee: APTAR FRANCE SAS, Le Neubourg (FR)

( * ) Notice: Subject to any disclaimer, the term of this patent is extended or adjusted under 35 U.S.C. 154(b) by 0 days.

(21) Appl. No.: 18/030,006

(22) PCT Filed: Oct. 1, 2021

(86) PCT No.: PCT/FR2021/051700
§ 371 (c)(1),
(2) Date: Apr. 3, 2023

(87) PCT Pub. No.: WO2022/069843
PCT Pub. Date: Apr. 7, 2022

(65) Prior Publication Data

US 2025/0074691 A1 Mar. 6, 2025

(30) Foreign Application Priority Data

Oct. 2, 2020 (FR) ..... 2010102

(51) Int. Cl.
*B65D 83/00* (2006.01)
*B65D 83/141* (2025.01)
*B65D 83/52* (2006.01)

(52) U.S. Cl.
CPC ..... *B65D 83/52* (2013.01); *B65D 83/141* (2025.01)

(58) Field of Classification Search
CPC ..... B65D 83/52; B65D 83/141
See application file for complete search history.

(56) References Cited

U.S. PATENT DOCUMENTS 3,547,317 A * 12/1970 Green ..... B65D 83/52 222/402.2
4,863,073 A * 9/1989 Burt ..... G01F 11/36 222/402.2

(Continued)

FOREIGN PATENT DOCUMENTS

FR 3 043 392 A1 5/2017

OTHER PUBLICATIONS

International Preliminary Report on Patentability and translation of Written Opinion of the International Searching Authority issued Mar. 28, 2023, in Application No. PCT/FR2021/051700.

(Continued)

*Primary Examiner* — Bob Zadeh
(74) *Attorney, Agent, or Firm* — Sughrue Mion, PLLC

(57) ABSTRACT

Metering valve having a valve body (10) containing a metering chamber (20) defined by a chamber insert (40) and a top and a bottom seal. The chamber insert (40) has a cylindrical wall (49) with an upper edge (41) cooperating with the top seal and a lower edge (43) with the bottom seal. A valve shut-off element (30) slides between rest position and dispensing positions. The valve shut-off element is urged towards its rest position by a spring (8) cooperating with the valve body (10) and the valve shut-off element. The lower edge of the chamber insert forms a flange and has a downward axial projection. The bottom seal has an axial opening (225) accepting an axial projection (45) and passing through the axial opening. The rest position of the valve shut-off element is defined by contact between the axial projection and a part of the valve shut-off element.

13 Claims, 1 Drawing Sheet

(56) References Cited

U.S. PATENT DOCUMENTS

| | | | | | |
|---|---|---|---|---|---|
| 5,037,012 | A * | 8/1991 | Langford | B65D 83/52 | 222/402.2 |
| 5,632,421 | A * | 5/1997 | Colombo | B65D 83/38 | 222/402.2 |
| 6,095,182 | A * | 8/2000 | Warby | F16K 3/265 | 222/402.1 |
| 6,170,717 | B1 * | 1/2001 | Di Giovanni | C22B 1/245 | 222/402.2 |
| 6,318,603 | B1 * | 11/2001 | Burt | B65D 83/52 | 222/402.1 |
| 6,644,306 | B1 * | 11/2003 | Riebe | B65D 83/52 | 128/200.14 |
| 6,978,915 | B1 * | 12/2005 | Russell | B65D 83/38 | 222/402.1 |
| 8,434,648 | B2 * | 5/2013 | Marie | B65D 83/36 | 222/402.1 |

OTHER PUBLICATIONS

International Search Report for PCT/FR2021/051700 dated, Feb. 7, 2022 (PCT/ISA/210).

* cited by examiner

METERING VALVE

CROSS REFERENCE TO RELATED APPLICATIONS

This application is a National Stage of International Application No. PCT/FR2021/051700 filed Oct. 1, 2021, claiming priority based on French Patent Application No FR2010102 filed Oct. 2, 2020.

The present invention relates to a metering valve for a device for dispensing a fluid product.

So-called metering valves, in which upon each actuation of the valve, a specific dose of fluid product is dispensed, are well-known in the state of the art, and are generally assembled on a reservoir containing the fluid product and a propellant used to perform the expulsion of the dose.

Two types of metering valves are mainly known. So-called retention valves comprise a valve shut-off element which, in the rest position, partially closes the metering chamber. More precisely, the outside of the valve shut-off element co-operates in leaktight manner with the chamber seal of the metering chamber such that, in the rest position, the metering chamber is connected to the reservoir only via the internal channel of the valve shut-off element. So-called non-priming valves comprise a metering chamber which, at rest, is open on the reservoir and which is filled at the time of actuation, when the user returns the device into the inverted position of use. In these types of valves, the rest and actuating positions of the valve shut off element are generally defined by elements that are more or less deformable, i.e. the compressed spring in the dispensing position, and the top seal in the rest position. Consequently, these positions are not always very exactly reproducible, in particular the rest position, which depends on the state of the top seal.

Documents FR3043392 and U.S. Pat. No. 3,547,317 describe devices of the state of the art.

An object of the present invention is to provide a metering valve that does not have the above-mentioned drawbacks.

An object of the present invention is thus to provide a metering valve in which the rest position of the valve shut-off element is independent of the seals of the valve.

A particular object of the present invention is to provide a metering valve that is simple and inexpensive to manufacture and to assemble, and that is reliable in operation.

An object of the he present invention is thus a metering valve for dispensing a fluid product, comprising a valve body containing a metering chamber, said metering chamber being defined by a chamber insert and two annular seals, a top seal and a bottom seal, said chamber insert comprising a cylindrical wall, of which an upper edge cooperates with the top seal and a lower edge cooperates with the bottom seal, wherein a valve shut-off element slides axially in the valve body between a rest position and a dispensing position, in order selectively to dispense the contents of said metering chamber, wherein the valve shut-off element is urged towards its rest position by a spring cooperating on the one hand with the valve body and on the other hand with the valve shut-off element, wherein the lower edge of the chamber insert forms a flange which extends radially inwards from the cylindrical wall, wherein the lower edge comprises at least one axial projection projecting axially downwards, and wherein the bottom seal comprises at least one axial opening, each axial opening accepting a respective axial projection and each axial projection passing completely through the respective axial opening so that the rest position of the valve shut-off element is defined by contact between the at least one axial projection of the chamber insert and a part of the valve shut-off element.

Advantageously, said lower edge comprises three axial projections distributed around its periphery.

Advantageously, said valve shut-off element comprises a radial collar which comprises a radial wall part, against which said spring bears, which is extended at its outer radial edge by an axial wall part extending axially upwards from said radial wall part, the upper axial edge of said axial wall part cooperating with the lower axial edge of said at least one axial projection to define the rest position of said valve shut-off element.

Advantageously, said collar includes at least one cutout in its periphery, aligned with a radial outlet channel and a radial inlet channel of said valve shut-off element.

Advantageously, said bottom seal includes, on its internal radial edge, a radial sealing lip that extends radially inwards and axially downwards.

Advantageously, in the rest position of said valve shut-off element, said radial sealing lip is positioned in a recess formed between the outer surface of said valve shut-off element and said axial wall portion of said collar of said valve shut-off element.

Advantageously, said bottom seal is fixed, in particular by assembly or overmolding, to said lower edge of said chamber insert.

Advantageously, said top seal comprises, on its internal radial edge, a radial sealing profile comprising a central recess defined between two radial projections that cooperate with said valve shut-off element to achieve sealing.

Advantageously, said top seal and/or said bottom seal include at least one axially projecting profile on at least one of its(their) upper and/or lower surfaces.

Advantageously, said metering chamber has a variable volume, in particular of between 25 and 75 μl, defined by the radial width of said cylindrical wall.

Another object of the present invention is a device for dispensing a fluid product comprising a metering valve such as described above, said valve being mounted on a reservoir containing the fluid product and a propellant.

Advantageously, said propellant comprises HFA-134a and/or HFA-227 and/or HFA-152a and/or HFO1234ze.

These characteristics and advantages and others of the present invention appear more clearly from the following detailed description thereof, given by way of non-limiting examples, and with reference to the accompanying drawings, and in which.

In the description below, the terms "top", "bottom", "lower", "upper" and "vertical" refer to the upright position represented in FIGS. 1 and 2, and the terms "axial" and "radial" refer to the longitudinal central axis X of the valve.

Figure 1:
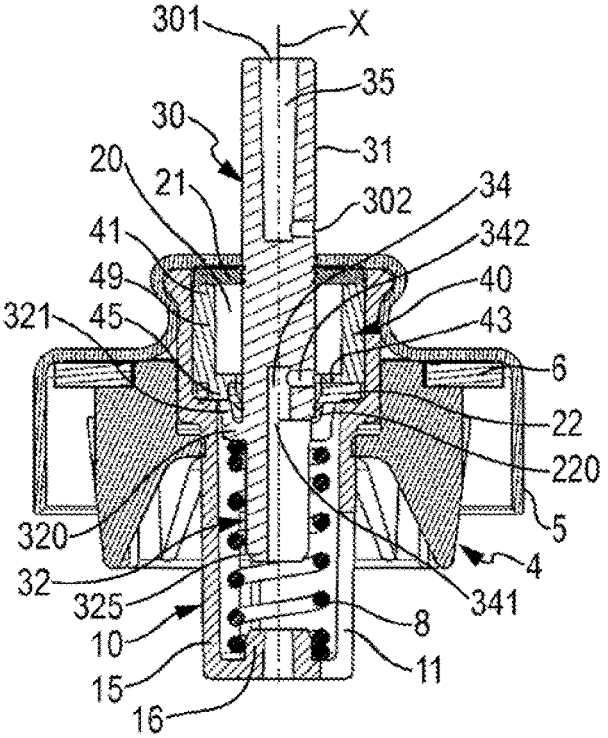
FIG. 1 is a transverse, cross-sectional schematic view of a dispensing valve according to an embodiment, in the rest position of the valve shut-off element, in the upright storage position of the valve.
Figure 2:
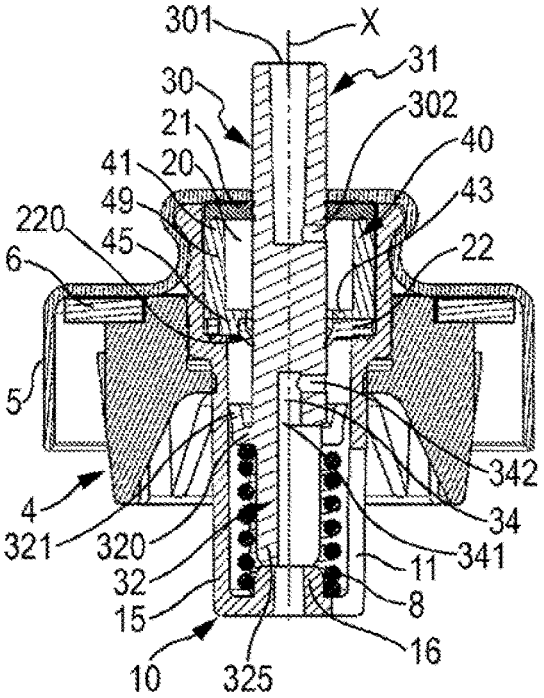
FIG. 2 is a view similar to the view in FIG. 1, in the dispensing position of the valve shut-off element.

FIG. 1 represents the valve in the upright storage position, i.e. the position in which the valve is arranged above the reservoir (not shown). FIG. 2 represents the valve in the dispensing position. It must be noted that the normal position of use of such a valve is an inverted position, with the valve arranged under the reservoir, but in this FIG. 2, the position of use of the valve has been represented in the upright position, to simplify the comparison with the rest position of FIG. 1.

The metering valve represented in FIG. 1 comprises a valve body 10 extending along a longitudinal central axis X. Inside said valve body 10, a valve shut-off element 30 slides between a rest position, which is the position shown in FIG. 1, and a dispensing position as shown in FIG. 2, in which the valve shut-off element 30 has been pushed into the valve body 10.

This valve is intended to be assembled on a reservoir (not shown) containing the fluid product and a propellant, preferably by means of a fixing element 5, which can be a crimpable, screw-fastenable, or snap-fastenable capsule, and advantageously with interposition of a neck seal 6. Possibly, a ring 4 can be assembled around the valve body 10, in particular to decrease the dead volume in the inverted position and so as to limit contact between the fluid product and the neck seal 6. This ring 4 can be of any shape, and the example of FIG. 1 is not limiting. In general, the reservoir contains the fluid product and the propellant, in particular a formulation made up of one or more active principle(s) in suspension and/or in solution in a liquefied propellant, as well as possible excipients. The propellant advantageously comprises an HFA gas, e.g. HFA 134a and/or HFA 227. Preferably, the propellant comprises HFA-152a. In a variant, other non-harmful gases can be used, such as HFO1234ze.

The valve shut-off element 30 is urged towards its rest position by a spring 8 that is arranged in the valve body 10 and that cooperates on the one hand with the valve body 10 and on the other hand with the valve shut-off element 30, preferably with a radial collar 320 of the valve shut-off element 30. A metering chamber 20 is defined inside the valve body 10, said valve shut-off element 30 sliding inside said metering chamber 20 so as to enable its contents to be dispensed when the valve is actuated.

Advantageously, the valve shut-off element 30 may be made of one single piece, namely a top portion 31 (also known as a valve shut-off element top) and a bottom portion 32 (also known as a valve shut-off element bottom). The top portion 31 comprises a central axial channel 35 provided with an axial outlet orifice 301 and a radial inlet channel 302 which is arranged in the metering chamber 20 when the valve shut-off element 30 is in its dispensing position. The bottom portion 32 includes said central internal channel 34 provided with an axial inlet orifice 341, and a radial outlet channel 342. The bottom portion 32 also includes the collar 320 on its outer surface.

The radial collar 320 comprises a radial wall part, against which the spring 8 bears, which is extended at its outer radial edge by an axial wall part 321 extending axially upwards from said radial wall part. Thus, a recess is defined between the outer surface of the valve shut-off element 30 and said axial wall portion 321.

Figure 6:
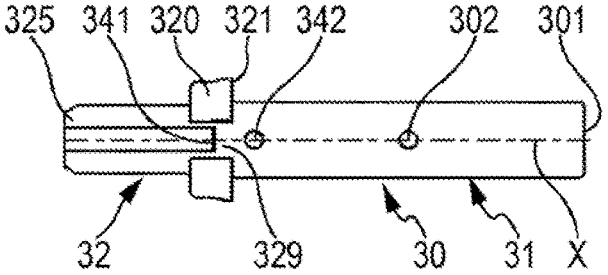
FIG. 6 is detailed view of the valve shut-off element.

The collar 320 may include at least one cutout 329 in its periphery, aligned with said radial outlet channel 342 and said radial inlet channel 302, as can be seen in FIG. 6.

The internal axial channel 34 makes it possible to connect the metering chamber 20 to the reservoir, so as to fill said metering chamber 20. Filling is performed when the device is in its upsidedown working position, with the valve arranged below the reservoir.

In the example in FIG. 1, when the valve shut-off element 30 is in its rest position, the metering chamber 20 is connected to reservoir 1 by the internal axial channel 34 of the valve shut-off element 30. In that rest position, the metering chamber 20 thus remains connected to the reservoir 1 and can be emptied by gravity in the upright position in FIG. 1. The valve represented in FIGS. 1 and 2 is thus a valve of the non-priming type. However, the invention is also applicable to other types of valve, in particular valves of the retention type.

The valve body 10 includes a cylindrical portion 15 in which the spring 8 is arranged, and in which the collar 320 slides between its rest and dispensing positions. In the position of FIG. 1, this cylindrical portion 15 is the lower portion of the valve body. This cylindrical portion 15 comprises one or more longitudinal openings 11, such as slots, extending laterally in said cylindrical portion 15 of the valve body, over a portion of the axial height of the valve body in the direction of the longitudinal central axis. These openings 11 make it possible to fill the metering chamber 20 before each actuation, when in the inverted position of use (with the valve arranged below the reservoir), the valve shut-off element 30 is in its rest position.

Advantageously, the pump body 10 comprises, at its lower axial edge, an axial profile 16 projecting upwards, to define the dispensing position of the valve shut-off element by cooperating with the lower edge 325 of the valve shut-off element 30. This implementation guarantees a precise and identical definition to each actuation of this dispensing position, independent from the compression of the spring 8. Also, it makes it possible to ease the spring 8, which makes it possible to increase its service life.

This axial profile 16 can advantageously be made in the shape of a sleeve radially offset inwards from said cylindrical portion 15, as represented in FIG. 1. This particular implementation makes it possible to form a receiving space for the spring 8 between said sleeve 16 and said cylindrical portion 15, making it possible to hold the spring 8 it in a repeatable position. It must be noted that this projecting profile 16 represented in FIG. 1 is not essential for the operation of the valve, and it could be implemented independently from the structure of the metering chamber.

The metering chamber 20 is defined between two annular seals, a top seal or valve shut-off element seal 21 and a bottom seal or chamber seal 22, in a well-known manner. This metering chamber 20 is filled before each actuation with a dose of fluid product from the reservoir, when the user returns the device into the inverted position.

The volume of the metering chamber 20 is defined by means of a chamber insert 40, of substantially cylindrical shape, with a cylindrical wall 49 having a more or less large radial thickness according to the desired volume. This volume can advantageously vary between 25 and 75 μl.

The top seal 21 rests on the upper edge 41 of the chamber insert 40, and the bottom seal 22 is in contact with a lower edge 43 of the chamber insert 40.

Figure 5:
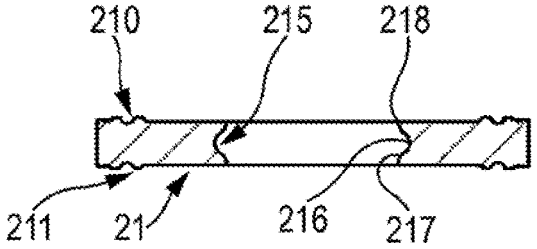
FIG. 5 is detailed view of the top seal.

Advantageously, the top seal 21 includes at least one first axially projecting profile 210 on its top surface and at least one second axially projecting profile 211 on its bottom surface. In the embodiment shown in FIG. 5, the first projecting profile 210 includes two concentric peripheral beads made in the vicinity of the outer radial edge of the top seal 21. Likewise, the second projecting profile 211 also comprises two concentric peripheral beads made in the vicinity of the outer radial edge of the top seal 21. It should be observed that the two axially projecting profiles 210, 211 are not necessarily identical. These axially projecting profiles 210, 211 improve the sealing between the chamber insert 40 and the fixing element 5.

On its internal radial edge, the top seal 21 advantageously comprises a radial sealing profile 215 to improve the dynamic sealing with the valve shut-off element 30 during its movement during the actuation of the valve. In the embodiment shown, the radial sealing profile 215 includes a central recess 216 defined between two radial projections 217, 218 that cooperate with the valve shut-off element 30 to achieve sealing. This implementation makes it possible to guarantee perfect sealing when the valve shut-off element 30 moves in one direction and then in the other direction during actuation.

Figure 4:
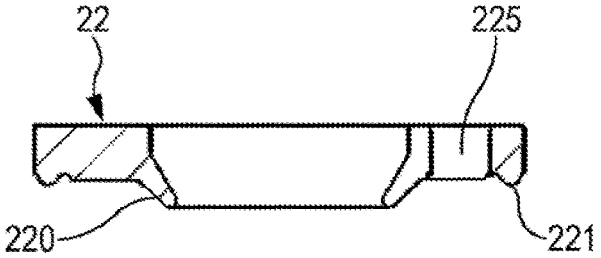
FIG. 4 is detailed view of the bottom seal.

Advantageously, the bottom seal 22 has an axially projecting profile 221 on its bottom surface. In the example shown in FIG. 4, the axially projecting profile 221 includes a peripheral bead that is made in the vicinity of the outer radial edge of the bottom seal 22. This axially projecting profile 221 improves sealing between the chamber insert 40 and the pump body 10.

On its internal radial edge, the bottom seal 22 advantageously comprises a radial sealing lip 220 to improve the dynamic sealing with the valve shut-off element 30 during its movement during the actuation of the valve. The deformable lip 220 extends radially inwards and axially downwards. This implementation makes it possible to guarantee perfect sealing when the valve shut-off element 30 moves in one direction and then in the other direction during actuation. Moreover, this radial sealing lip allows easy filling of the reservoir through the valve without risk of damaging the bottom seal 22.

The lower edge 43 of the chamber insert 40 forms a flange which extends radially inwards from the cylindrical wall 49.

Figure 3:
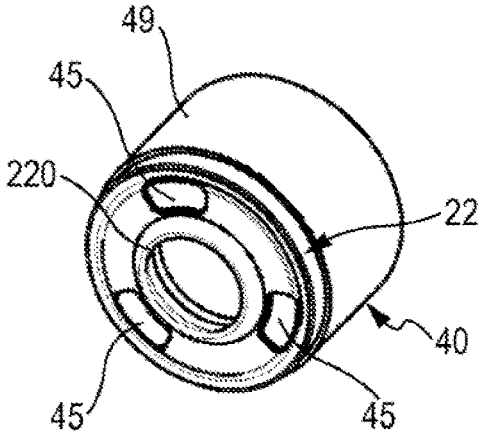
FIG. 3 is a detailed perspective view of the assembly formed by the chamber insert and the bottom seal.

According to the invention, said lower edge 43 includes at least one axial projection 45 projecting axially downwards. In the example of FIG. 3, there are four axial projections 45 distributed around the periphery. Correspondingly, the bottom seal 22 includes at least one axial opening 225, each receiving an axial projection 45 of the chamber insert 40. Each axial projection 45 passes completely through its respective axial opening 225. Thus, in the rest position of the valve shut-off element 30, the upper axial edge of the axial wall portion 321 of the collar 320 of the valve shut-off element 30 is in contact with the lower axial edge of each axial projection 45 of the chamber insert 40. Thus, the rest position of the valve shut-off element 30 is defined by contact between two rigid parts of the valve, and is therefore independent of the seals, and in particular of the top seal 21.

In this rest position, the radial sealing lip 220 of the bottom seal 22 is positioned in the recess formed between the outer surface of the valve shut-off element 30 and the axial wall portion 321 of the collar 320 of the valve shut-off element 30. This makes it possible to avoid any axial contact between said lip 220 and the valve shut off element, and thus to preserve the integrity of said sealing lip. Furthermore, this embodiment makes it possible to limit the dead volume in the valve.

The bottom seal 22 can be assembled mechanically on the lower edge 43 of the chamber insert 40. Advantageously, the lower seal 22 is overmolded onto the lower edge 43 of the chamber insert 40.

Although the present invention is described above with reference to a particular embodiment thereof, naturally it is not limited by the examples shown. On the contrary, any useful modification could be applied thereto by a person skilled in the art, without going beyond the ambit of the present invention, as defined by the accompanying claims.

The invention claimed is:

1. A metering valve for dispensing a fluid product, comprising a valve body containing a metering chamber, said metering chamber being defined by a chamber insert and two annular seals, a top seal and a bottom seal, said chamber insert comprising a cylindrical wall, of which an upper edge cooperates with the top seal and a lower edge cooperates with the bottom seal, wherein a valve shut-off element slides axially in the valve body between a rest position and a dispensing position, in order selectively to dispense contents of said metering chamber, wherein the valve shut-off element is urged towards the rest position by a spring cooperating on the one hand with the valve body and on the other hand with the valve shut-off element, wherein the lower edge of the chamber insert forms a flange which extends radially inwards from the cylindrical wall, wherein the lower edge comprises at least one axial projection projecting axially downwards, and wherein the bottom seal comprises at least one axial opening, each axial opening accepting a respective axial projection and each axial projection passing completely through the respective axial opening so that the rest position of the valve shut-off element is defined by contact between the at least one axial projection of the chamber insert and an axial wall part of the valve shut-off element.

2. The valve according to claim 1, wherein said lower edge includes three axial projections distributed around a periphery of the lower edge.

3. The valve according to claim 1, wherein said valve comprises a radial collar which comprises a radial wall part, against which said spring bears, which is extended at an outer radial edge of the radial wall part by the axial wall part extending axially upwards from said radial wall part, the upper axial edge of said axial wall part cooperating with the lower axial edge of said at least one axial projection to define the rest position of said valve shut-off element.

4. The valve according to claim 3, wherein said collar includes at least one cutout in a periphery of the collar, aligned with a radial outlet channel and a radial inlet channel of said valve shut-off element.

5. The valve according to claim 1, wherein said bottom seal includes, on an internal radial edge of the bottom seal, a radial sealing lip that extends radially inwards and axially downwards.

6. The valve according to claim 5, wherein, in the rest position of said valve shut-off element, said radial sealing lip is positioned in a recess formed between an outer surface of said valve shut-off element and said axial wall part of said collar of said valve shut-off element.

7. The valve according to claim 1, wherein said bottom seal is fixed, by assembly or overmolding, to said lower edge of said chamber insert.

8. The valve according to claim 1, wherein said top seal comprises, on an internal radial edge of the top seal, a radial sealing profile comprising a central recess defined between two radial projections which cooperate with said valve shut-off element to achieve sealing.

9. The valve according to claim 1, wherein said top seal and/or said bottom seal include at least one axially projecting profile on at least one of top and/or bottom surfaces of the top seal or the bottom seal.

10. The valve according to claim 1, wherein said metering chamber has a variable volume defined by a radial width of said cylindrical wall.

11. The valve according to claim 10, wherein the variable volume is between 25 and 75 μl.

12. A device for dispensing the fluid product, comprising the metering valve according to claim 1, said valve being mounted on a reservoir containing the fluid product and a propellant.

13. The device according to claim 12, wherein said propellant comprises HFA-134a and/or HFA-227 and/or HFA-152a and/or HFO1234ze.

* * * * *